US005945614A

United States Patent [19]

White

[11] Patent Number: 5,945,614

[45] Date of Patent: Aug. 31, 1999

[54] MODULAR GUITAR SYSTEM

[76] Inventor: Timothy P. White, 146 Lull Rd., New Boston, N.H. 03070

[21] Appl. No.: 09/129,931

[22] Filed: Aug. 6, 1998

[51] Int. Cl.[6] ..... G10D 1/08; G10D 3/02; G10D 3/04

[52] U.S. Cl. ..... 84/267; 84/291; 84/293; 84/298

[58] Field of Search ..... 84/267, 290–293, 84/297 R, 298, 299

[56] References Cited

U.S. PATENT DOCUMENTS

| | | | |
|---|---|---|---|
| 4,073,211 | 2/1978 | Jorgensen | 84/291 |
| 4,111,093 | 9/1978 | Field et al. | 84/267 |
| 4,433,603 | 2/1984 | Siminoff | 84/1.16 |
| 4,573,391 | 3/1986 | White | 84/291 |
| 4,686,882 | 8/1987 | Shaw | 84/291 |
| 5,058,479 | 10/1991 | Shaw | 84/291 |

*Primary Examiner*—Stanley J. Witkowski
*Attorney, Agent, or Firm*—Bourque and Associates, PA

[57] ABSTRACT

An improved, modular guitar system is disclosed and includes a guitar body frame, which has a central member disposed along a longitudinal axis of the body frame and a peripheral rim member defining a peripheral shape of the body frame. The system also includes a separate acoustic grill, which is made up of first and second grill sections that are removably attached to the peripheral rim member of the body frame only. The system also includes a removable guitar neck and headstock assembly, which includes a headstock/string retention mechanism, which allows the guitar to be disassembled without allowing the strings to unravel from the guitar string tuning machines. The system also includes an inflatable acoustic chamber, which is attached to the guitar body frame along the guitar body frame peripheral rim member. The inflatable acoustic chamber includes a membrane communicating with the guitar body acoustic grill sections when the acoustic chamber is inflated.

20 Claims, 15 Drawing Sheets

MODULAR GUITAR SYSTEM

FIELD OF THE INVENTION

The disclosed invention comprises a modular guitar system. More particularly, the invention is directed to a modular, inflatable, acoustic guitar system, which includes interchangeable components to provide varied acoustic characteristics.

BACKGROUND OF THE INVENTION

Guitars generally consist of a body and an elongated neck and a plurality of strings, which are tensioned between a headstock at one end of the neck and a bridge, which is attached to the guitar body. In an acoustical guitar, the guitar body consists of spaced panels, including a body face panel, a body back panel and body side panels, which define a resonance chamber to provide the instrument with a desired tonal qualities.

The rigid attachment of the neck to the body and the size of the body causes the guitar to be relatively large and cumbersome to handle, transport and store. However, the need for strength within the body and neck to allow the guitar strings to be tensioned, and the requirement for the resonant chamber of the body has dictated acoustical guitar construction and bulk. A number of inventions have considered guitar constructions, which attempt to reduce the bulk of guitars for transportation and storage purposes. Examples of such inventions can be found in U.S. Pat. Nos. 4,073,211; 4,111,093; 4,433,603; 4,686,882; and 5,058,479. Many of these prior art collapsible guitars still result in a bulky size and require special carrying cases and special care when transporting. Others are more compact and are easily transportable. However, in order to provide such compactability, these guitars sacrifice acoustic performance.

U.S. Pat. No. 4,573,391, which issued to and is commonly owned by the applicant of the present invention, discloses an inflatable knock-down guitar, which overcame many of the deficiencies found in many of the prior art knock-down guitar patents. This reference teaches a knock-down guitar, which can be utilized in either an acoustic or electric mode, and which includes a plurality of guitar components that disassemble in such a manner as to permit the instrument to be placed within a conventional suitcase, thus eliminating the need for special carrying cases.

The '391 Patent teaches that an inflatable bladder can be utilized as a resonance chamber for the guitar system disclosed therein when it is used in its acoustical mode. This guitar system, which is known as the CHRYSALIS™ Universal Guitar System, includes a family of interchangeable guitar components, which provides a number of features including: the ability of a guitarist to break down a full-size, full-function electric guitar to a shirt box size package for transport and to re-assemble the instrument to playing condition in a minimal time period, including the re-tuning and re-tuning of the guitar strings; allowing the same electric guitar to be quickly and easily converted to a full-size, full-function acoustic guitar by attaching an inflatable acoustic chamber to the guitar body; allowing a musician to easily and quickly make a variety of significant alterations to the guitar's quality or function by providing a plurality of separately available interchangeable components, including, headstocks, necks, body panels and bridges.

The advantages of the CHRYSALIS™ guitar system include the ability to assemble the instrument in any configuration and to maintain that configuration entirely by string tension. Furthermore, the CHRYSALIS™ guitar system teaches that all system components can be manufactured out of injection molded plastics common carbon fiber composites or lightweight metals, which allows a wide range of system performance characteristics and associated price ranges. Additionally, with the CHRYSALIS™ guitar system, all action, neck, and intonation adjustments could be made with three easily accessible set screws at the junction of the CHRYSALIS™ guitar's neck and body.

However, perhaps the most significant advance taught by the CHRYSALIS™ guitar system is the use of a new type of acoustic sound board analogue composed of a carbon fiber composite grill work, which, in the CHRYSALIS™ guitar's acoustic mode supports a polymer membrane under tension.

One embodiment of a prior art modular guitar system 1 is shown in FIG. 1. Guitar 1 consists of a guitar body 2, a guitar neck 4, a headstock 6, bridge 8 and a plurality of strings (not shown). The strings are attached to the bridge 8 at one end and, at the headstock, the strings are attached to individual guitar string tuning machines 12.

The prior art guitar body 2 includes a face panel 14 consisting of first and second face panel sections 14A and 14B, respectively. The face panel sections are preferably formed in a lattice configuration and are made of any one of a number of synthetic materials, such as fiberglass and resin. The face panel 14 includes a periphery 16 panel which defines the shape of guitar body 2 when guitar body sections 14A and 14B are assembled.

Guitar body sections 14A and 14B are each provided with a pair of dovetail recesses 18, which are configured to accept corresponding dovetail projections 20, which are provided on the underside of guitar bridge 8.

The guitar body sections 14 are also provided with recesses 22, which are configured to accept neck section 4. The body section 14 is maintained in its proper relationship by joining corresponding mating surfaces 24 and 26, inserting neck section 4 into recesses 22 and inserting bridge projections 20 into their corresponding dovetail recesses 18 on body sections 14A and 14B.

The prior art neck section further includes dowels 30, which extend through neck wings 34 and into holes 32 in body face panels 14A and 14B. This configuration maintains the alignment of neck section 4 with respect to body 2.

At its outer end, neck 36 is provided with an angle block 38, which engages the outer end of the neck and includes a pair of elongated rectangular pins 40 received within neck slots 42. A retainer plate 44 attaches to the underside of neck 36 overlapping slots 42 to maintain pins 40 within their respective slots. A screw 46 holds retainer plate 44 in place.

Angle block 38 also includes two angled pins 48, which extend from angle block 38 in a direction opposite elongated rectangular pins 40, which is the direction of headstock 50.

The headstock 50 includes holes, not shown for receiving angled pins 48 in order to align headstock 50 with neck 36 via angle block 50. The headstock 50 also includes a recess on its underside for receiving a tensioning lever 52 pivoted about pivot shaft 54. Tensioning lever 52 includes a convex cam surface adapted to engage the angle block between pins 48 and, as will be appreciated, rotation of lever on 52 vary the distance between angle block 38 and headstock 50. Thus, the guitar stones attached to tuning machines 12 at one end and bridge section 8 at their other ends may be tensioned and detensioned as lever arm 52 is repositioned.

The body section 2 further includes an inflatable acoustic chamber, which is made up of a flexible envelope 60 within which an inflatable bladder 62 is inserted. The envelope 60 is attached to the periphery of body face panels 14 using an attachment means 72 such as a zipper, Velcro components, snaps or similar fasteners.

The prior art also discloses interchangeable bridges, such as electrical guitar bridge 8'. Electric guitar bridge 8' includes components necessary to convert the modular guitar system 1 from an acoustic mode 2 and electric mode. Electric guitar bridge 8 thus includes pickups 82, and controls 84. The electric guitar bridge 8', like acoustic guitar bridge 8 includes dovetail projections 20', which are configured to be accepted within dovetail recesses 18 on body base panels 14A and 14B, respectively.

As disclosed in the '391 Patent, the CHRYSALIS™ guitar body is comprised of two separate body grills, which are held together and in planner alignment by the guitar's bridge and a common neck joint. However, one drawback of the CHRYSALIS™ guitar system is that the separate body grills taught therein include both structural and acoustical braces. Accordingly, if one were to desire to modify the acoustical characteristics of the prior art CHRYSALIS™ guitar, one would be forced to replace both body grills in their entirety.

Another drawback of the combined structural and acoustical braces of the prior art CHRYSALIS™ guitar system is that the acoustical braces communicate with the structural braces along each body grill's central, longitudinal structural brace. This, although offering superior structural integrity, limits the vibrational characteristics of the acoustical braces, which adversely affects the acoustic performance of the CHRYSALIS™ guitar system.

Another drawback associated with the combined structural and acoustical frameworks of the prior art CHRYSALIS™ guitar is that in order to provide proper sound board analog acoustic compliance, the two body halves are only joined where they attach to the guitar neck and by the string bridge. Accordingly, in order to provide the necessary structural integrity, the body frame edges that are located along the central longitudinal axis of the guitar body in the assembled state, must themselves be structural frame members. This requires substantial dimensions, which further precludes the acoustical framework from freely vibrating and transmitting maximum vibrational energy to the guitar's acoustical chamber.

The prior art CHRYSALIS™ guitar includes a removable headstock, which rotates vertically off the neck of the guitar to allow the breakdown of the instrument as a whole. The CHRYSALIS™ guitar headstock utilizes a quick release mechanism, which allows for the rapid de-tensioning and re-tensioning of the guitar strings utilizing a lever mechanism. However, when the CHRYSALIS™ guitar strings are de-tensioned, they tend to unravel from the tuning machine posts provided on the headstock, which defeats the ability to rapidly reassemble and tune the guitar. One attempt that has been tried to overcome this problem is to add an external, add-on string clamp at the base of the headstock, which can be manually manipulated prior to de-tensioning the guitar strings using the headstock lever arm. Once the clamp is tightened, tension is maintained on each string between the clamp and their respective tuning machine posts, thus preventing unwanted string unraveling. However, this prior art solution to the problem requires a separate operator action and requires a somewhat unsightly additional mechanism on the guitars headstock.

Furthermore, the prior art CHRYSALIS™ guitar system, while teaching the interchangeability of necks, bridges, and headstocks, the neck body joint taught is crude and does not provide the ease of interchangeability required for commercial acceptance. Furthermore, since the neck of the prior art CHRYSALIS™ guitar serves more purposes than that of a normal guitar neck, the prior art CHRYSALIS™ guitar neck was required to be made from either solid high-modulus graphite-epoxy composite, aluminum stock or an equivalent solid structure.

Accordingly, there is a need for an improved inflatable, knock-down guitar, which overcomes the acoustic compliance, assembly, and structural deficiencies associated with prior art collapsible guitar systems, including the prior art CHRYSALIS universal guitar system.

SUMMARY OF THE INVENTION

The present invention provides an improved, modular guitar system, which overcomes the deficiencies noted above. The disclosed modular guitar system comprises a guitar body frame, which has a central member disposed along a longitudinal axis of the body frame and a peripheral rim member defining a peripheral shape of the body frame. The peripheral rim member communicates with the central member at first and second ends of the guitar body frame. The guitar system also includes a separate acoustic grill, which is made up of first and second grill sections. The first and second grill sections each have a peripheral edge corresponding to the shape of the guitar body frame. The peripheral edge of the acoustic grill sections are removably attached to the guitar body frame peripheral member. The first and second grill sections also have a free edge, which is disposed substantially collinear with the body frame central member intermediate the first and second ends of the guitar body frame when the grill sections are attached to the guitar body frame.

The modular guitar system also includes a guitar neck having a first end, which is removably attached to the first end of the guitar body frame. The guitar neck has also has a second end, which is attached to a headstock. The headstock includes at least one guitar string tuning machine for retaining a first end of at least one guitar string and adjusting tension of the guitar string. Each guitar string has a second end, which is attached to a guitar string bridge. The guitar string bridge straddles the body frame central member and is removably attached to the first and second acoustic grill sections on opposite sides of the body frame central member to acoustically couple the guitar string to the acoustic grill sections via the bridge.

The modular guitar system also includes an inflatable acoustic chamber, which is attached to the guitar body frame along the guitar body frame peripheral rim member. The inflatable acoustic chamber includes a membrane communicating with the guitar body acoustic grill sections when the acoustic chamber is inflated.

In one preferred embodiment of the invention, the guitar body comprises two body frame sections, which have mating surfaces along a central, longitudinal axis of the guitar system to provide a substantially rigid guitar body frame central member disposed along the central, longitudinal axis when the body frame section mating surfaces are mated. Each body frame section further includes a peripheral rim member, which extends from the mating surfaces to define a peripheral shape of the guitar body. Thus, by including a two-section guitar body frame, a modular guitar system according to this embodiment of the invention can be disassembled to a further reduced size to facilitate transport and storage.

DESCRIPTION OF THE DRAWINGS

These and other features and advantages of the present invention will be better understood by reading the following detailed description, taken together with the drawings wherein.

DETAILED DESCRIPTION OF THE PREFERRED EMBODIMENT

Figure 1:
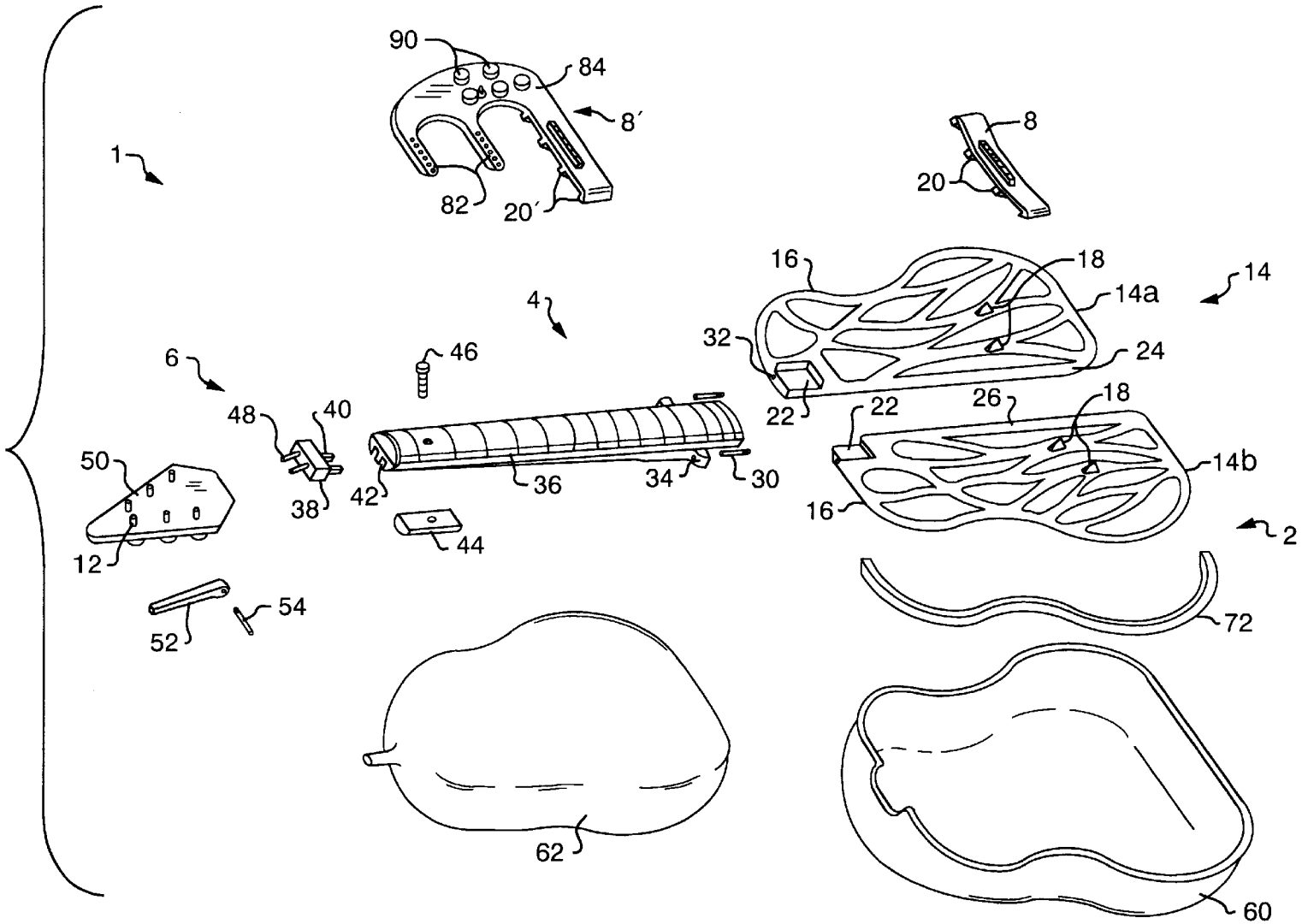
FIG. 1 is an exploded, perspective view of a prior art CHRYSALIS guitar system.
Figure 2:
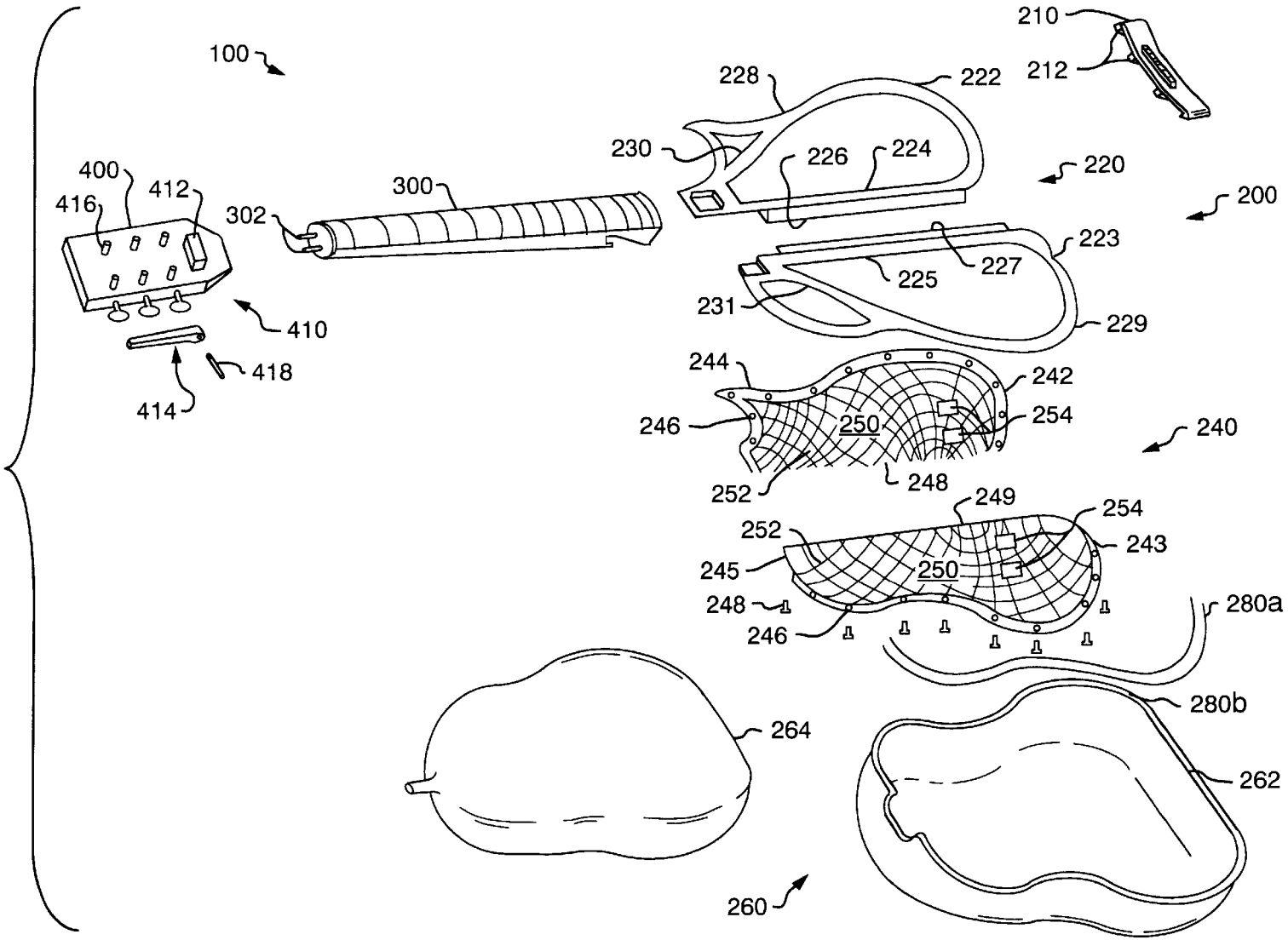
FIG. 2 is an exploded, perspective view of the modular guitar system of the present invention.

One embodiment of a modular guitar system 100 according to the teachings of the present invention is shown in FIG. 2. Like its prior art inflatable guitar sibling, modular guitar system 100 includes a plurality of components, which are joined together to form a playable instrument. Modular guitar system 100 includes guitar body section 200, guitar neck section 300 and guitar headstock section 400.

Guitar body section 200 includes guitar bridge 210, guitar body frame 220, acoustic grills 240, inflatable, acoustic chamber 260, which is attached to guitar body frames 220 using attachment means 280.

Figure 4:
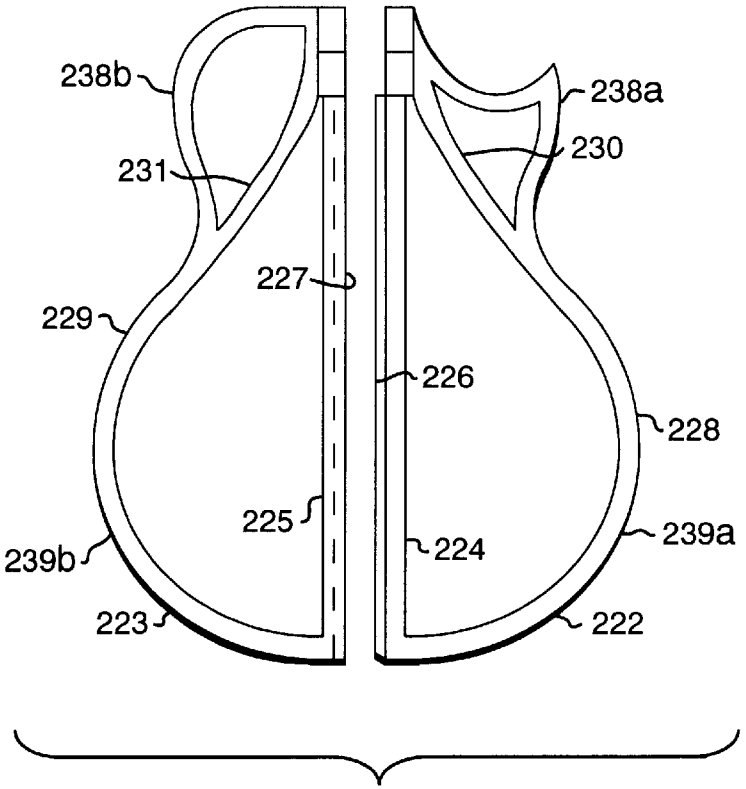
FIG. 4 is a top view of a guitar body frame according to a second embodiment of the invention, which includes two guitar body structural frame sections.

In one embodiment of the invention guitar body frame 220 includes first and second structural body frame sections 222 and 223 (FIGS. 2 and 4). Each structural body frame section includes a longitudinal, central member 224 and 225, which include corresponding mating surfaces 226 and 227.

Structural body frames sections 222 and 223 also include peripheral rim members 228 and 229, which extend from first and second ends of longitudinal members 224 and 225 and, which define the peripheral shape of the guitar body, including upper bouts 238*a*, 238*b* and lower bouts 239*a*, 239*b* of the guitar body frame 220 when the first and second sections 222 and 223 are mated using corresponding mating surfaces 226 and 227. Each structural body frame section also includes at least one additional structural member 230 and 231, which in the embodiment illustrated in FIG. 2 are shown as buttresses connecting the first end of each guitar body longitudinal member 224 and 225 to its corresponding peripheral rim member 228 and 229 substantially at the lower bout of each body frame section. This arrangement provides superior structural integrity to the structural body frame sections when they are exposed to guitar string tension.

In one embodiment, mating surfaces 226 and 227 comprise a longitudinal dovetail joint disposed substantially along the entire length of longitudinal numbers 224 and 225. Since it is envisioned that structural body frame sections 222 and 223 may be manufactured using injection molding or like processes, which could result in minor molding inconsistencies and imperfections, in the preferred embodiment, mating dovetails 226 and 227 include a hollow male dovetail section 226, which provides suitable flexibility in order to account for molding inconsistencies and, at the same time, provides structural integrity.

Figure 8A:
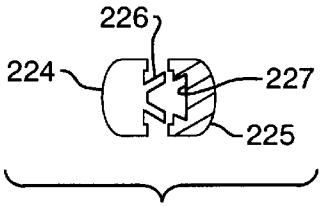
FIG. 8A is a close-up sectional view of one embodiment of the guitar body frame longitudinal mating surfaces.
Figure 8B:
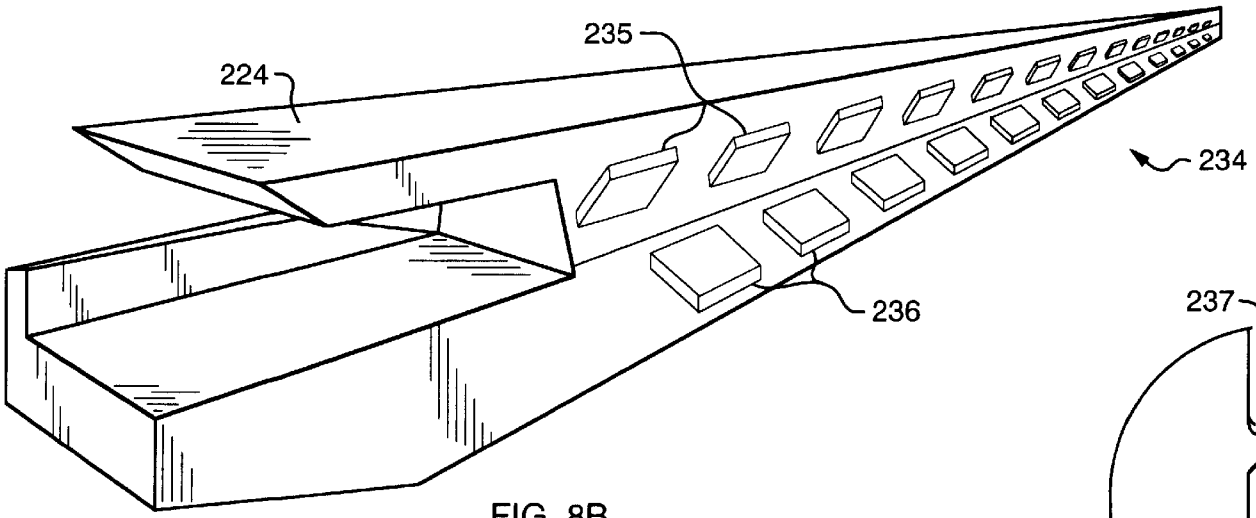
FIG. 8B is a perspective view of a second embodiment of a hollow, segmented male member of the guitar body frame longitudinal mating surfaces.
Figure 8C:
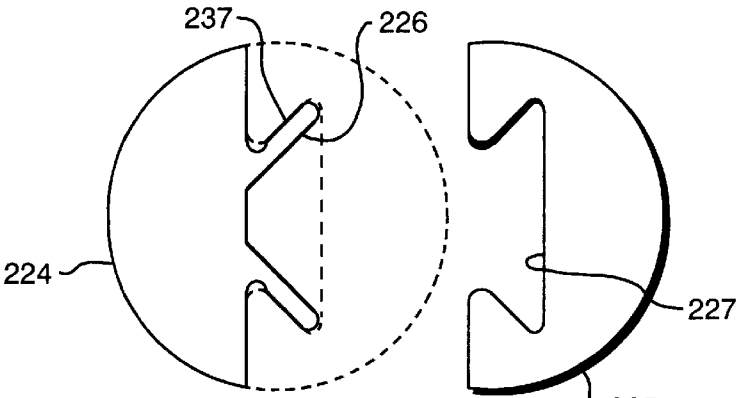
FIG. 8C is a close up sectional view of another embodiment of the guitar body frame longitudinal mating surfaces.
Figure 9A:
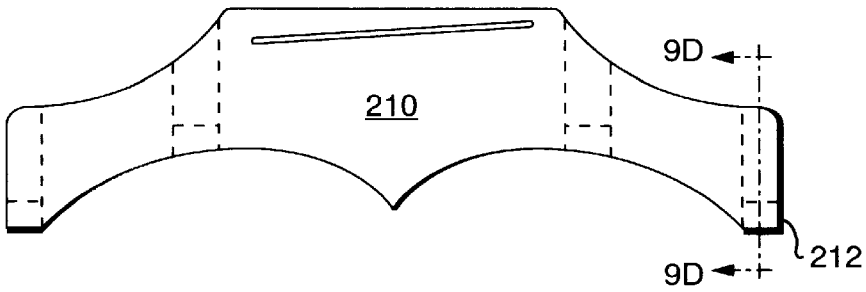
FIG. 9A is a top view of the guitar bridge of FIG. 7.
Figure 9B:
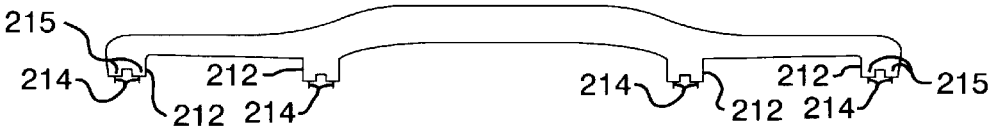
FIG. 9B is an end view of the guitar bridge of FIG. 9A.
Figure 9C:
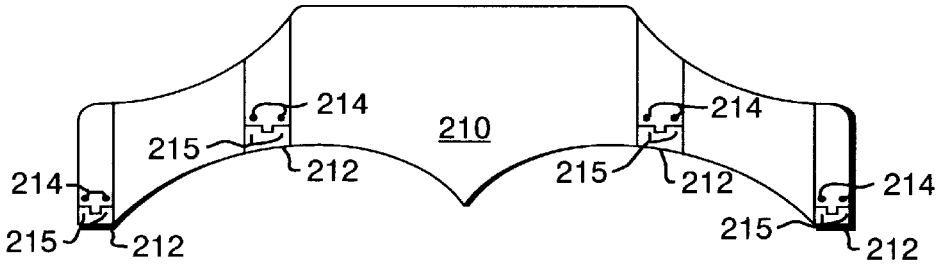
FIG. 9C is a bottom view of the guitar bridge of FIGS. 9A and 9B.
Figure 9D:
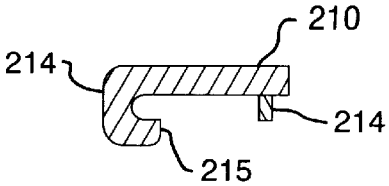
FIG. 9D is a sectional view of the guitar bridge taken along line DD of FIG. 9A.

In another embodiment, hollow male dovetail section 226 comprises a segmented dovetail 234 (FIG. 8B), which includes alternating upper and lower dovetail projections 235 and 236, respectively. This arrangement allows for even greater flexibility to account for molding imperfections. In either hollow dovetail arrangement mentioned above, the dovetail projections may be slightly convex mating surfaces, 237, which provide a single line of contact along each dovetail projection. Again, this arrangement is tailored to allow proper joints to be formed even in the presence of molding imperfections.

Figure 3:
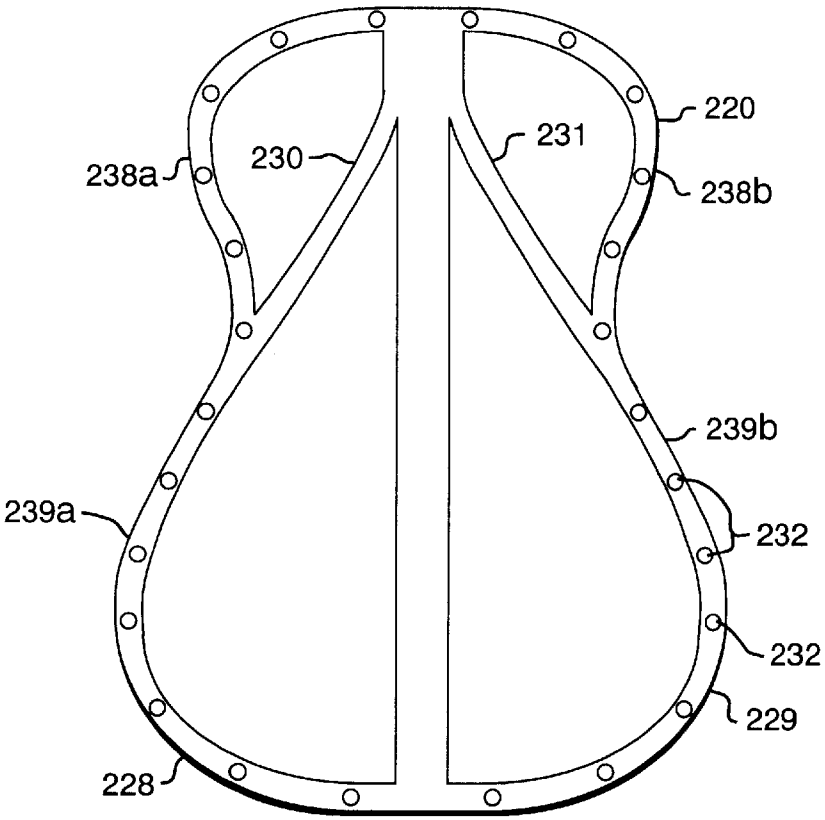
FIG. 3 is a bottom view of a guitar body frame according to a first embodiment of the invention.
Figure 5A:
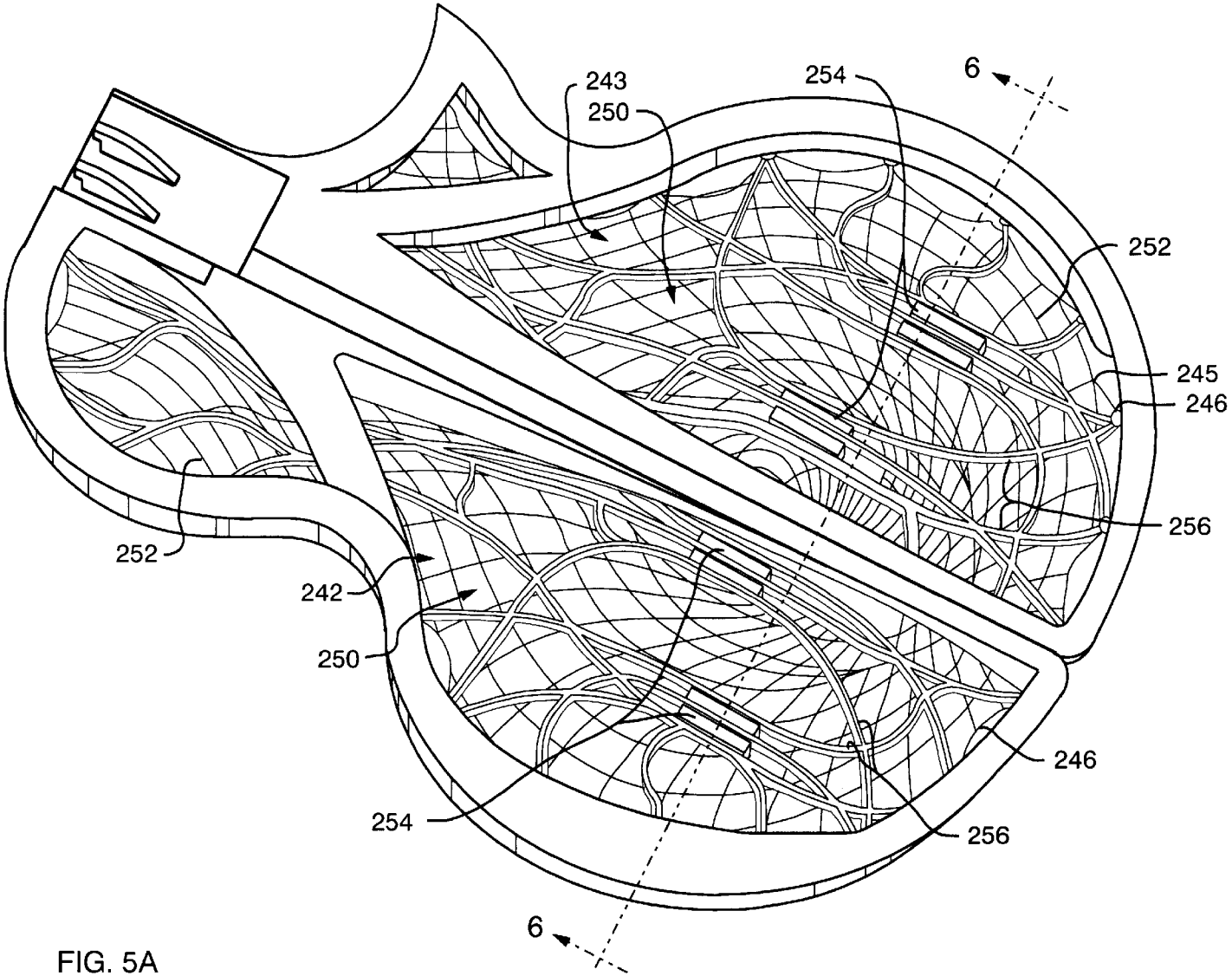
FIG. 5A is a top perspective view of the disclosed first and second acoustic grill sections mounted within a guitar body frame.
Figure 5B:
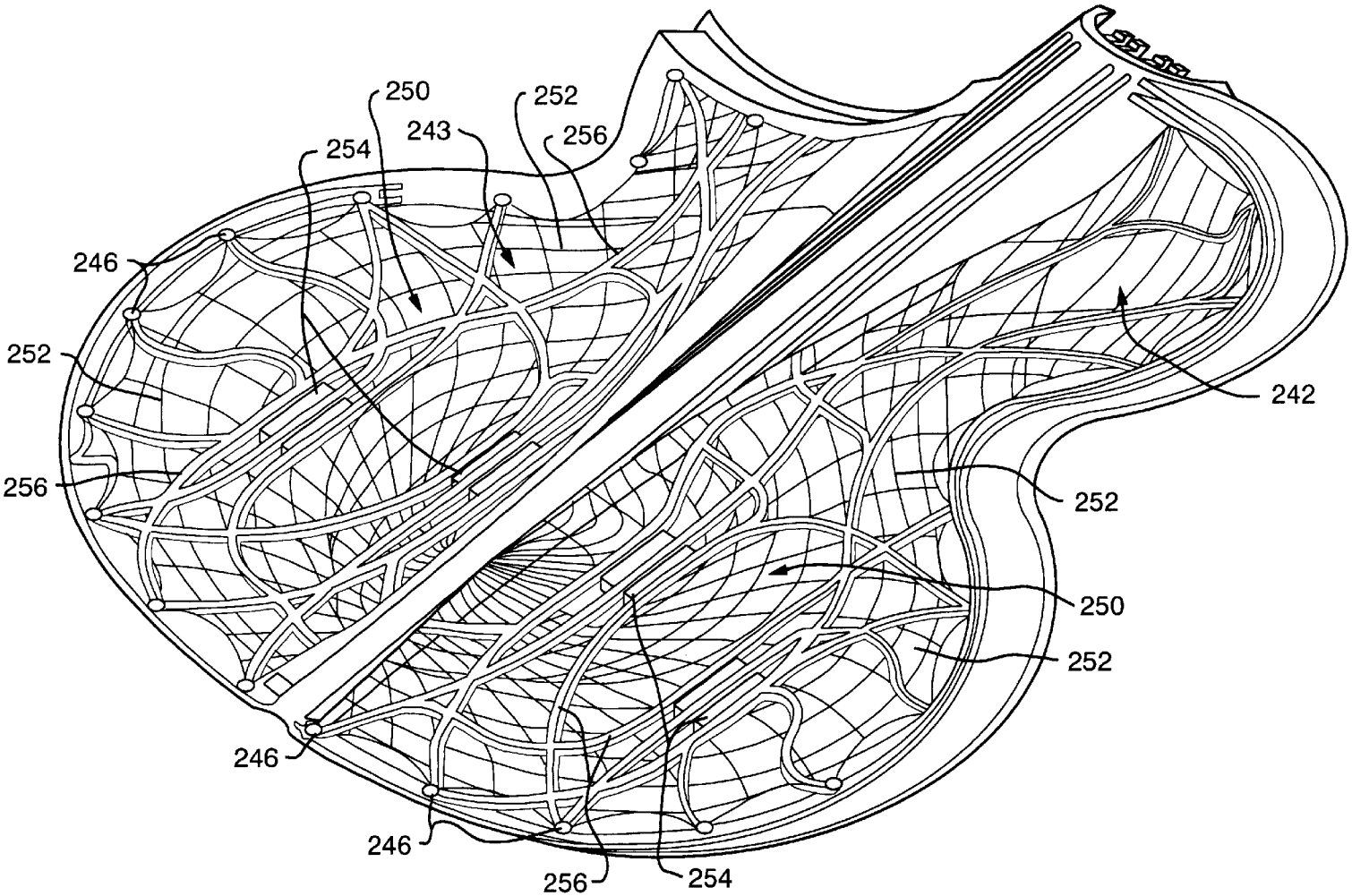
FIG. 5B is a bottom perspective view of the disclosed first and second acoustic grill sections mounted within a guitar body frame.

Guitar body section 200 also includes acoustic grill 240 (FIGS. 2, 5A and 5B), which comprises first and second acoustic grill sections 242 and 243. Grill sections 242 and 243 each include peripheral rim sections 244 and 245, which corresponds substantially to the peripheral shape of guitar body peripheral members 228 and 229, respectively. Acoustic grill sections 242 and 243 also include retention members 246, which in the disclosed embodiment include holes through which fasteners 248 can be inserted. Holes 246 correspond to receivers 232 (FIG. 3) disposed within the underside of structural body frame sections 222 and 223. In the preferred embodiment, receivers 232 comprise threaded holes or inserts, into which threaded fasteners 248 are threaded to hold grill sections 242 and 243 to the underside of structural body frame sections 222 and 223, respectively. Acoustic grills 242 and 243 are only joined to body frame sections 222 and 223 along peripheral rims 244 and 245 respectively, central, longitudinally disposed sections 248 and 249 remain free to allow for optimum vibration of acoustic grill sections 242 and 243.

The acoustic grill sections are made up of a lattice-like grill which may be made from any one of a number of acceptable materials, such as fiberglass, light metals, such as aluminum, or composite materials. The grill work 250 (FIGS. 5A & 5B) comprises a mesh with variable spacing and shapes of the grill mesh members 252. The exact spacing and design of the grill mesh can vary to adjust or vary the acoustical qualities of the instrument.

In order to impart sufficient structural integrity to the grill work 250, strength members 256 are overlaid onto grill mesh members 252. The strength members 256 provide the analog to soundboard bracing members found on wooden soundboard guitars and, like their wooden counterparts may be applied in a wide variety of shapes, sizes and patterns to produce differing acoustical performance characteristics for their respective instruments. The strength members are also sized, shaped, oriented and arranged such that the acoustic grill sections will have their maximum stiffness at the bridge attachment points 254 and their maximum flexibility at their peripheries, including their longitudinally disposed sections 248 and 249 and their peripheral members 228 and 229 at locations remote from the bridge attachment points 254.

Figure 6:
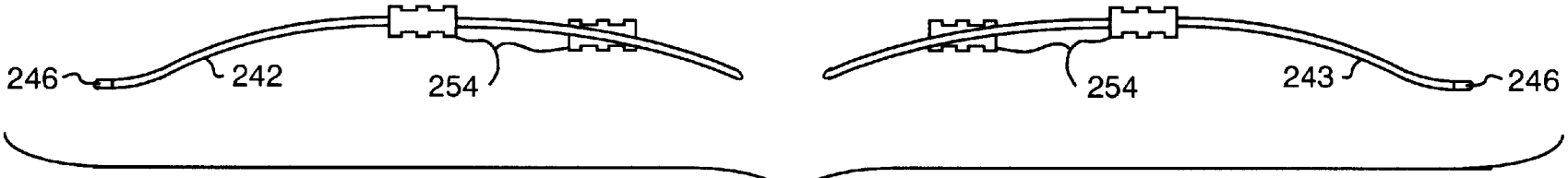
FIG. 6 is a sectional view of the acoustic grill sections shown in FIG. 5A along axis 66.
Figure 7:
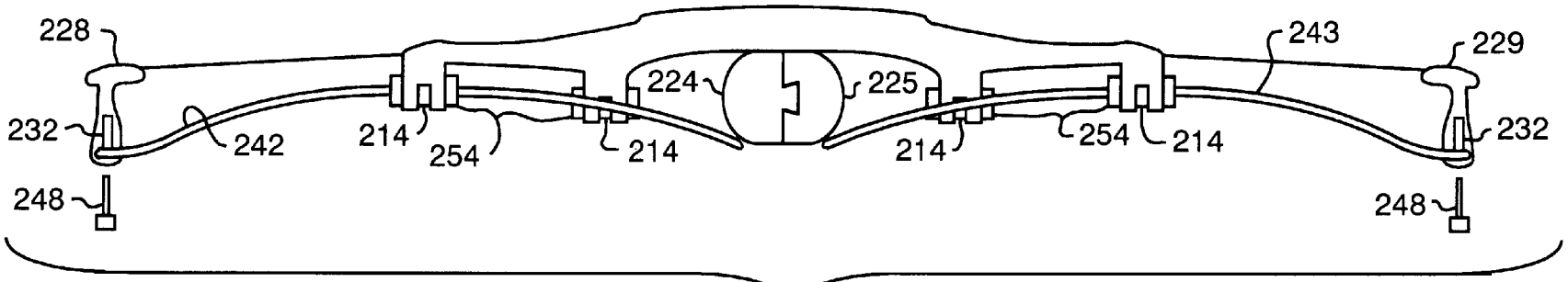
FIG. 7 is a sectional view of first and second acoustic grill sections shown joined by the guitar bridge and attached to the guitar body structural frame member.

As shown in FIG. 6, the acoustic grills 242 and 243 may be domed to provide greater grill area within the confines of the dimensions of the guitar structural frame. Acoustic grill sections may also be pre-stressed in a longitudinal fashion to counteract forces applied by guitar string tension.

However, in order to provide acoustical qualities substantially corresponding to traditional wooden guitars, grill mesh spacing (or grill pitch) should fall within the range of 0.5 inches to 2.0 inches. This spacing or grill pitch range is desirable to allow the guitar soundboard analog to produce sound waves corresponding the typical guitar tone frequencies, including high frequency sound waves having frequencies of substantially 6,000 Hz, which have wavelengths of substantially 0.75 inches.

One advantage of this feature of the present invention is that it allows for the interchangeability of acoustic grill sections within a single structural body frame. Thus, the acoustic qualities of such a modular guitar system can be adjusted by replacing grills. Also, it is envisioned that grill sections will be manufactured from materials that vary in expense. Accordingly, an entry level guitar system can be upgraded to a performance level guitar merely by replacing acoustic grills. Other components, such as the structural body frame 220, neck 300, headstock 400 and bridge 210 may be continued to be used. Of course, any one of those sections could be replaced as well.

Like its prior art inflatable guitar sibling, the modular guitar system 100 of the present invention utilizes a quick release-type assembly for removably attaching guitar bridge 210 to the acoustic grill sections 242 and 243. Each grill section includes two grill attachment points 254, which are connected to grill section strength members in order to provide the requisite strength to the grill sections at these critical areas. However, unlike the dovetail arrangement used in the prior art Chrysalis guitar, the bridge of the present invention uses hook-shaped members 212, which project from the underside of the bridge 210 to cooperate with the grill attachment points 254. In the preferred embodiment, each hook-shaped member includes twin hooks 215, which straddle a grill strength member that runs longitudinally through the center of each bridge attachment point and engage the bridge attachment points 254.

In order to provide additional strength to the structure, there is an also a molded pin 214 associated with each hook-shaped projection 212, which engages a corresponding hole 255 in each grill attachment point 254. In order to install the bridge onto the grill sections 242 and 243, the bridge 210 is lined aligned with the grill sections such that each hook-shaped projection lines up with its corresponding bridge attachment point 254 is then rotated, headstock end upward and the hook-shaped projections are lowered such that their respective hooks 215 engage the bridge attachment points 254 from the end of the body distal from the neck attachment end. The bridge is then rotated in the opposite manner (headstock end downward) as the bridge is slid towards the neck attachment end of the guitar body until the pins 214 engage their corresponding holes 215. Like its prior art sibling, once the bridge is installed it is held in place by string tension.

In order to provide proper acoustic guitar compliance, the disclosed modular guitar system 100 includes an inflatable acoustic chamber 260, which is attached to the guitar body structural body 220. In one embodiment, inflatable acoustic chamber 260 includes an outer flexible, protective envelope 262, which houses an inner inflatable bladder 264. Envelope 262 corresponds to the peripheral shape of the guitar body and provides protection to bladder 264 to prevent bladder 264 from rupturing easily. Bladder 264 may also be in the shape of the guitar body 220. However, this is not required. In any event, inflatable acoustic chamber 260 is joined to the guitar body structural frame along its peripheral members 228 and 229 using attachment means 280*a* and 280*b*, which may include zippers, Velcro or other quick release fasteners.

Figure 19:
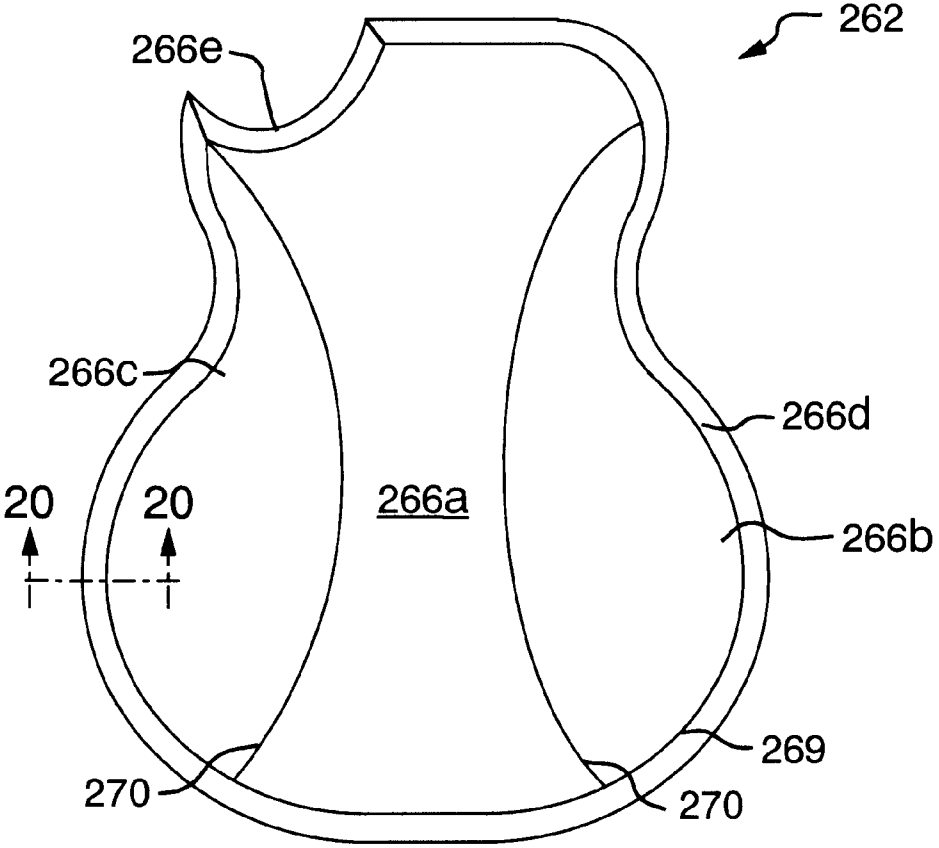
FIG. 19 shows a back view of the protective envelope, which houses the inflatable bladder of the inflatable guitar of the present invention.

Since an inflatable bladder will tend to try to expand in a spherical fashion, which would not be desirable for the shape of a guitar back, the protective envelope may be constructed out of a number envelope members, which may be, for example, pieces of a flexible fabric, such as cotton. The envelope members are joined, for example, using common sewing techniques to aid in providing a proper guitar back-like shape to the inflatable bladder. FIG. 19 shows a protective envelope 262, which is made up of a number of fabric sections 266*a–e* that are joined to form the protective envelope. Shaping seams, such as plateau seam 269 and princess seams 270, aid in forming the proper guitar back-like shape to the protective envelope 262.

Figure 10:
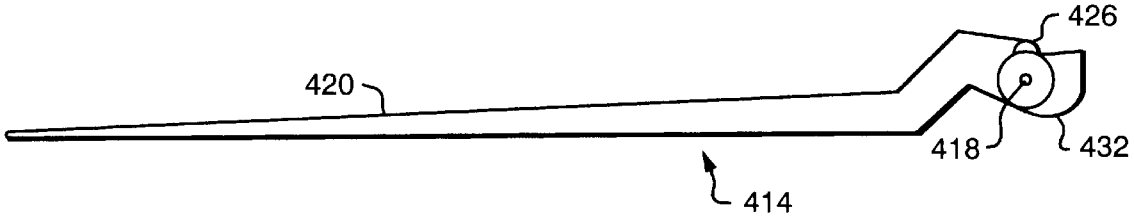
FIG. 10 is a side view of dual action cam lever of the present invention.
Figure 11:
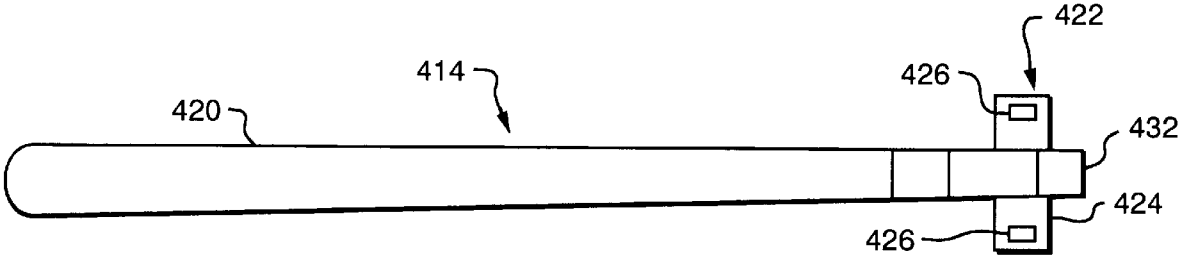
FIG. 11 is a top view of the dual action cam lever of FIG. 9.
Figure 12:
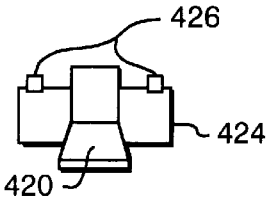
FIG. 12 is a sectional view of the cam section of the dual action cam lever along section 12:12 of FIG. 10.
Figure 13:
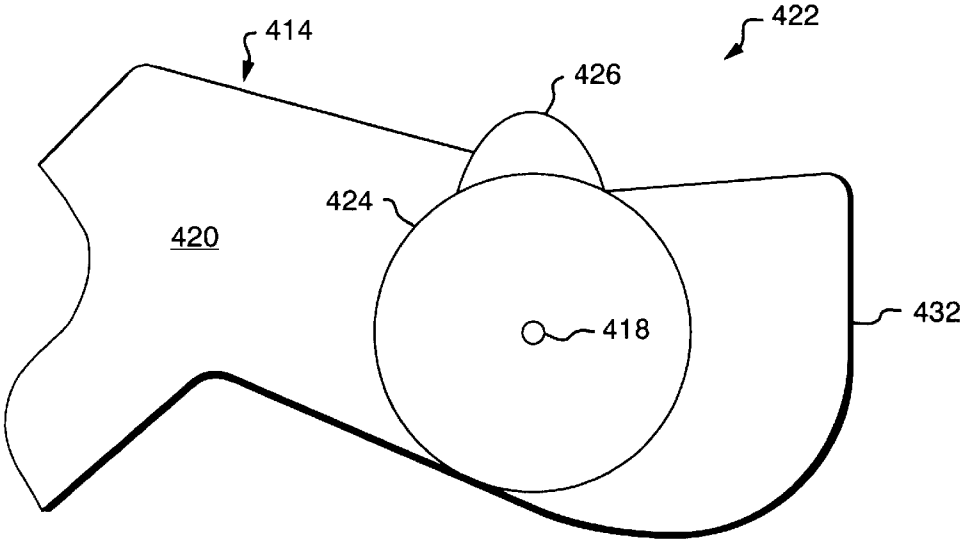
FIG. 13 is a close-up side view of the cam section of the dual action cam lever.
Figure 14A:
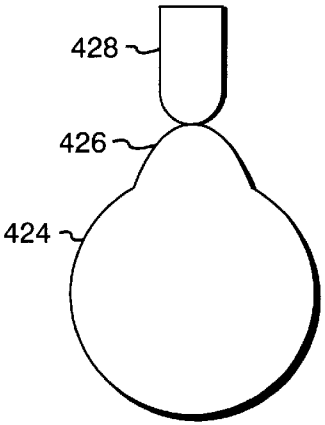
FIG. 14A shows the position of a first cam of the dual action cam lever in the playing position.
Figure 14B:
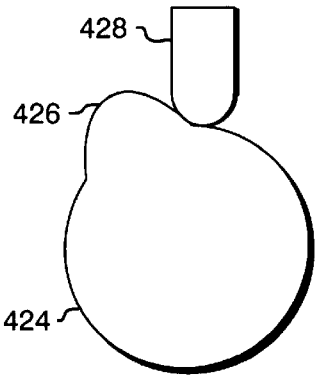
FIG. 14B shows the cam section of the dual action cam lever in a string retention position.
Figure 14C:
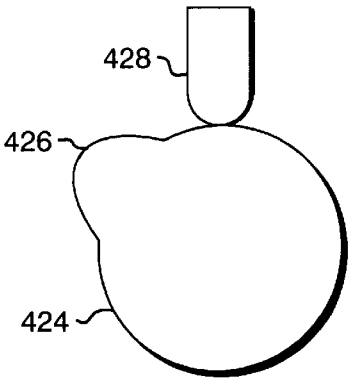
FIG. 14C shows the cam section of the dual action cam lever in the string detension position.
Figure 20:
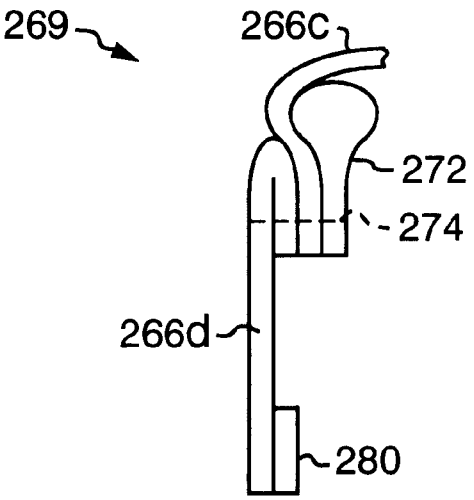
FIG. 20 shows a sectional view of the protective envelope components, which aid in approximating the shape of a wooden acoustic guitar.

The details of plateau seam 269 are shown in FIG. 20. The plateau seam 269 is formed by joining side panel 266*d* to back panel 266*c* in combination with a stiffening element 272. In the preferred embodiment, stiffening element 272 comprises boning, which provides stiffness, and thus shape to the seam. The boning 272 is preferably attached to side panel 266*d* as well as to top panel 266*c* using stitches 274 according to well known sewing techniques in the configuration shown in FIG. 10.

Turning now to FIGS. 2 and 10 through 15C, an improved headstock/string retention mechanism 410 is shown. The headstock/string retention mechanism includes a string clamp 412 and a multi-cam lever arm 414, which cooperates with headstock 400, string clamp 412 and neck 300 in order to longitudinally position the headstock 400 with respect to neck 300 allowing for the rapid tensioning and de-tensioning of guitar strings, while at the same time firmly clamping the guitar strings within string clamp 412 in other than the playing position to prevent the strings from unraveling from tuning machines 416. Multi-cam lever arm 414 is pivotally attached to headstock 400 using pivot pin 418.

Multi-cam lever 414 includes a lever arm 420, which extends in a longitudinal direction from cam section 422. Cam section 422 includes a first cam 424, which includes two cam heads 426, which are configured to communicate with corresponding pins 428 of string clamp 412, to raise the string clamp and allow strings 430 to be adjusted by tuning machines 416 when the headstock/string retention mechanism is in the playing position.

Furthermore, when the headstock/string retention mechanism 410 is in the playing position, a second cam 432 engages with neck 300 to extend headstock 400 in a longitudinal direction away from neck 300. Longitudinal positioning of the headstock with respect to the neck is accomplished using two headstock alignment pins 302, which extend from the headstock end of neck 300 and corresponding headstock alignment recesses 434, which are similarly sized and shaped to headstock alignment pins 302.

Figure 15A:
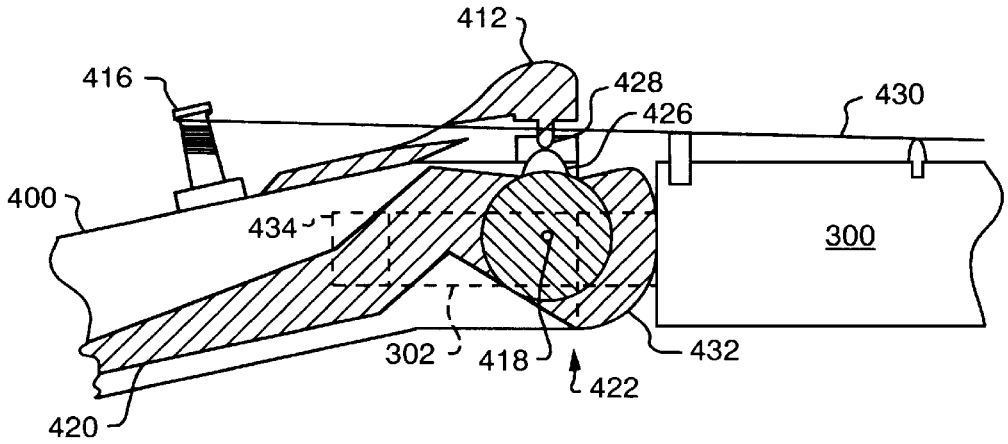
FIG. 15A is a side sectional view of the dual action cam lever in the playing position.
Figure 15B:
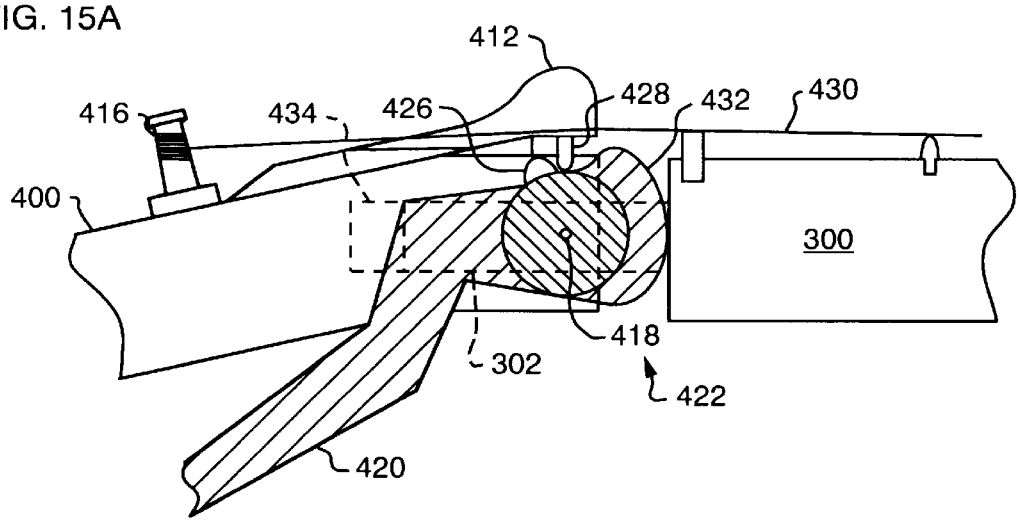
FIG. 15B is a side sectional view of the dual action cam lever in the string retention position.

When the multi-cam lever 414 is positioned into a second, string retention position, as shown in FIG. 15B, lever arm 420 is rotated about pin 418 downward from the headstock 400, which rotates cam section 422 to release cam heads 426 from their communicating relationship with string clamp projections 428. In this position, spring clamp 412 engages string 430, which maintains tension on string 430 between spring clamp 412 and tuning machine 416, thus preventing string 430 from unraveling off of tuning machine 416 when the guitar system is disassembled. String clamp 412 may be manufactured out of a spring-like material, such as spring steel or may be spring biased to ensure that string clamp 412 maintains adequate clamping power on string 430 when string clamp 412 is in other than the playing position.

Figure 15C:
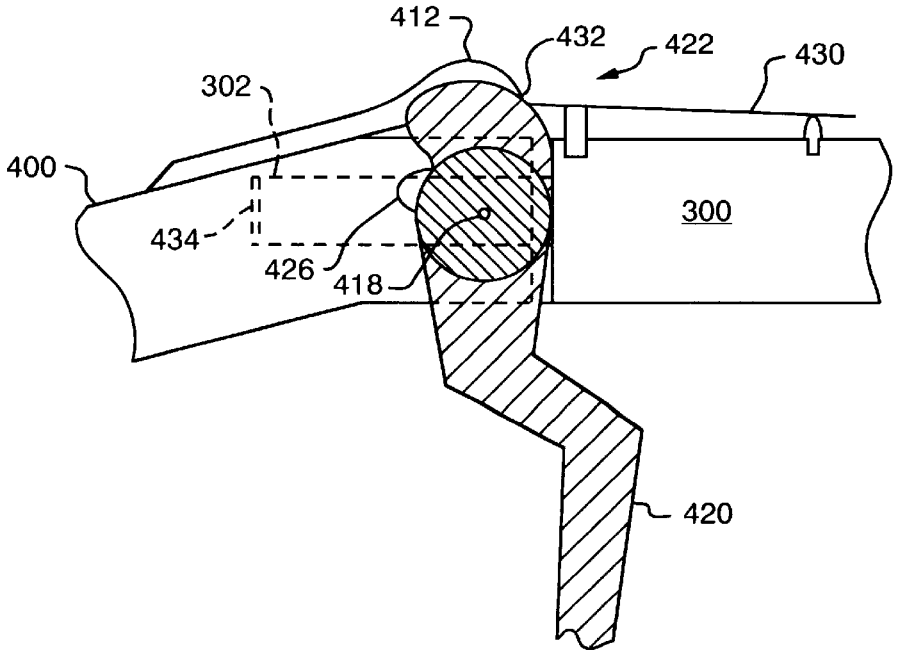
FIG. 15C is a side sectional view of the dual action cam lever in the string detensioning position.
Figure 16:
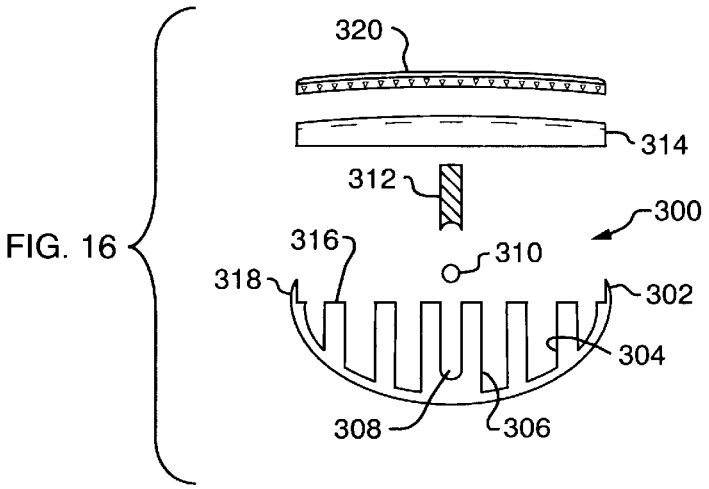
FIG. 16 is an exploded sectional view of a guitar neck according to the present invention.
Figure 17:
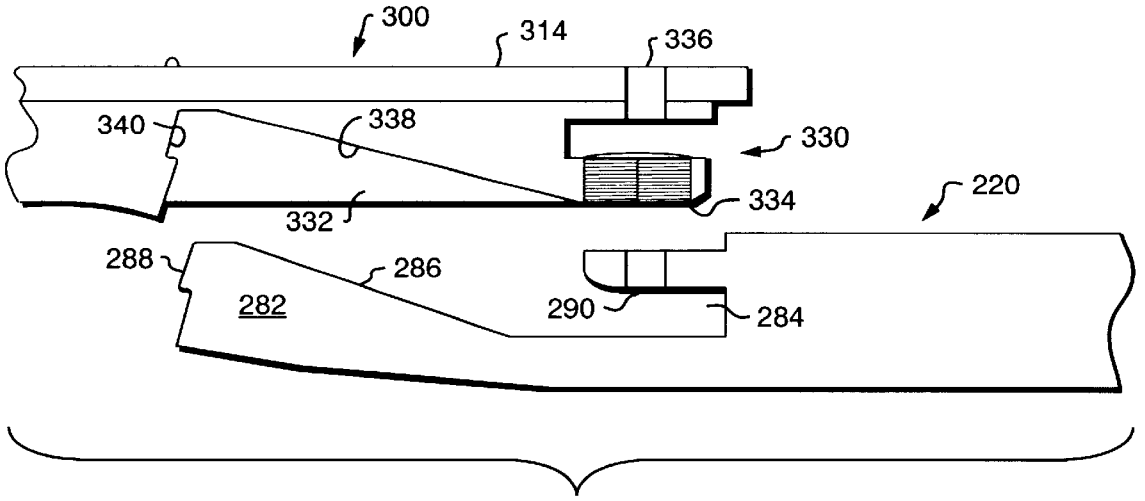
FIG. 17 is a cutaway side view of the mating surfaces of the guitar neck and the guitar body frame.

A third position of the headstock/string retention mechanism is shown is FIG. 15C. In this position, lever arm 420 is further rotated, which releases second cam 432 and allows headstock 400 to slide in a longitudinal direction towards neck 300, thus releasing string tension between string clamp 412 and guitar bridge 210 (FIG. 2). In this position, guitar bridge 210 can be removed from guitar body 200 and, in turn, neck 300 can be removed therefrom. Finally, headstock 400 may be removed from the headstock end of neck 300 as well.

The modular guitar system of the present invention also includes a novel neck construction as shown in FIG. 18. Neck 300 includes neck body 302, which is preferably a semi-hollow, injection molded plastic structure, which includes a plurality of longitudinal strength ribs 304, which provide rigidity to the neck in a longitudinal direction when the neck is placed under the tension applied by the guitar strings. Also included is a central rib 306, which itself includes an axial slot 308, which is sized and shaped to accept a guitar tension rod 310. Also included is a tension rod shim 312, which is inserted into slot 308 on top of tension rod 310 to hold tension rod 310 within the slot. Tension rods are well known in the guitar art and may be provided in a number of specific configurations, any one of which would be acceptable to a guitar manufactured according to the present invention.

Once the guitar tension rod 310 and tension rod shim 312 are inserted into neck body 302, they are held in place by fingerboard 314, which is inserted into neck body 302. The disclosed invention utilizes a novel fingerboard neck joint, which includes fingerboard recess 316, which is molded into neck body 302. In this manner, neck body 302 includes projections 318, which wrap around the sides of fingerboard 314 to provide a superior fingerboard neck body joint. Fingerboard 314 is preferably bonded to neck body 302 using chemical bonding agents.

Of course, neck 300 may also include front wires 320, which are inserted into fingerboard 314 as is well known in the art. Furthermore, guitar neck 300 also includes guitar nut, at the headstock end of neck 300 to define, in conjunction with the guitar bridge 210, the string length or scale length of the guitar.

The modular guitar system of the present invention also includes a novel neck/body joint, which allows for the rapid insertion and removal of the neck, ensures proper neck alignment and allows for micro-adjustability of the neck angle. This is especially critical since it is envisioned that guitar necks and bodies manufactured according to the principles of the present invention will be manufactured using injection molding techniques, which result in higher tolerances of dimensions, which must be compensated for in the guitar design.

At the body end of guitar neck 300 is an attachment fork 330 and an alignment/engagement recess 332. Corresponding to these components, first and second guitar body frame sections 222 and 223, which are joined to form guitar body 220, include alignment/engagement protrusions 282, and a neck fork receptacle 284. Neck fork 330 includes a threaded adjuster 334, which is accessible via an adjustment hole 336 in fingerboard 314. The structural frame 220 also includes an adjustment hole 290. Thus, when neck 300 is inserted into body frame 220, the neck angle can be adjusted using threaded adjuster 334 by inserting a screwdriver or other like instrument through adjustment hole 336 in fingerboard 314, through adjustment hole 290 in the structural body frame 220 and engaged threaded adjuster 334.

Body frame engagement/alignment protrusion 282 includes an angled surface 286, which corresponds to a similarly angled surface 338 in neck body 300. At the end of alignment protrusion 282 is a positive locking boss 288, which is sized and shaped to fit into locking receptacle 340 in alignment/engagement recess 332. Boss 288 extends a distance from protrusion 282, for example 0.065 inches, which is sufficient to allow positive locking of the neck in the playing position and yet allows the neck to be moved, in an axial direction, away from body frame 220 when the guitar strings are detensioned a sufficient distance to allow neck 300 to be rotated, headstock end upward, in order to allow neck 300 to be easily removed from body frame 220.

Figure 18A:
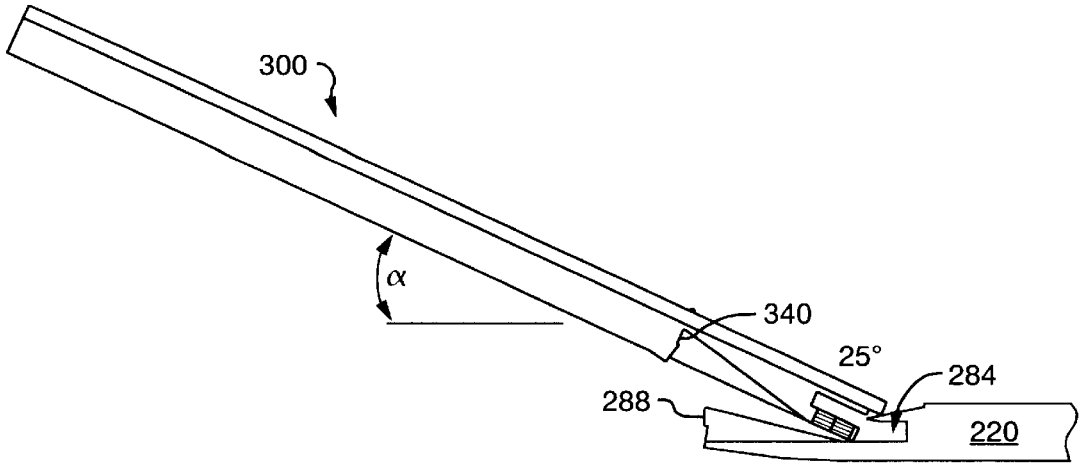
FIGS. 18A through H show cutaway side views of a sequence of guitar neck and body positions as the guitar neck is installed on the guitar body frame.
Figure 18B:
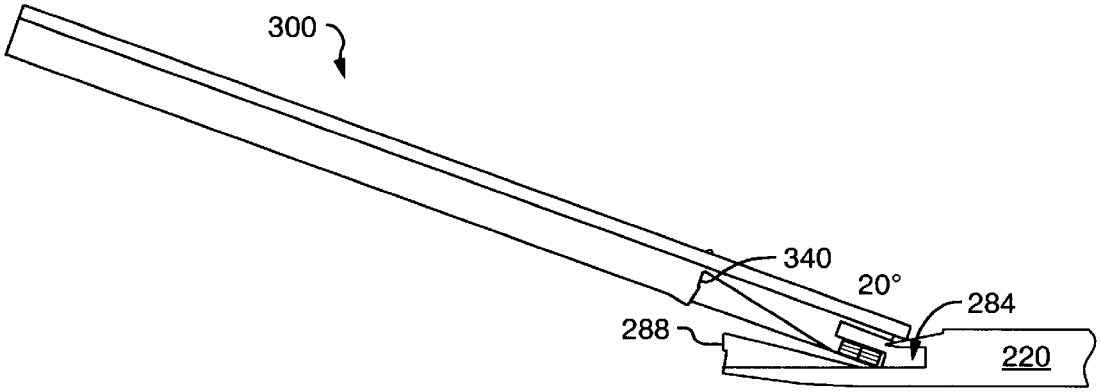
Figure 18C:
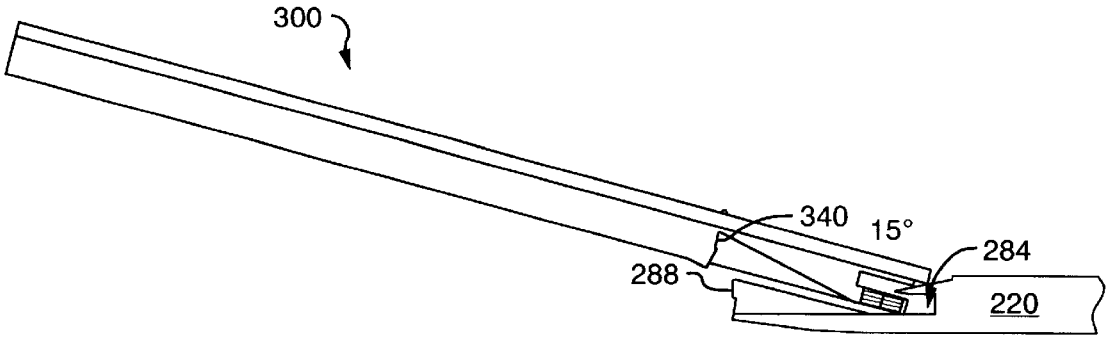
Figure 18D:
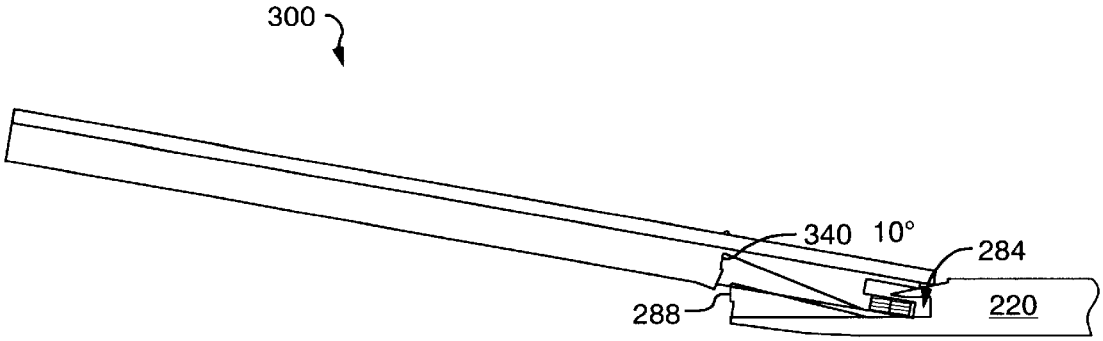
Figure 18E:
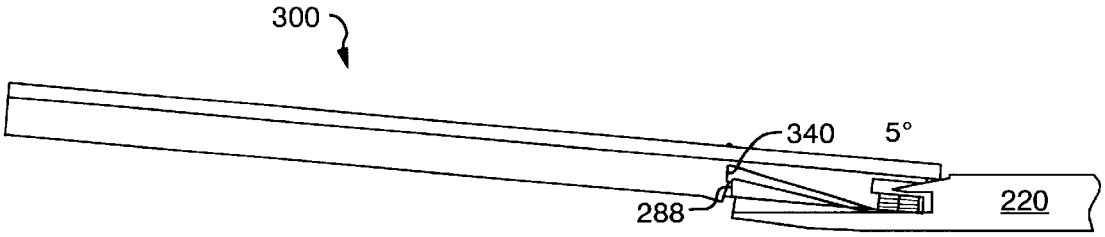
Figure 18F:
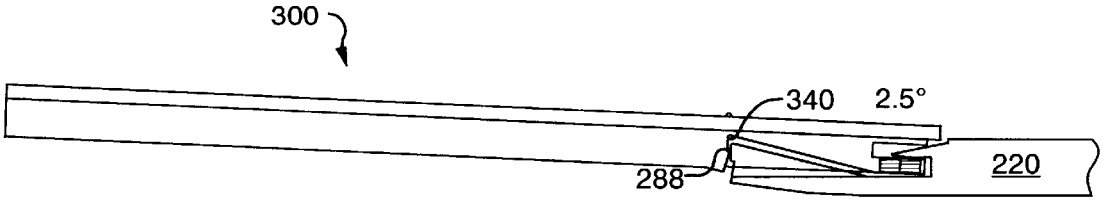
Figure 18G:
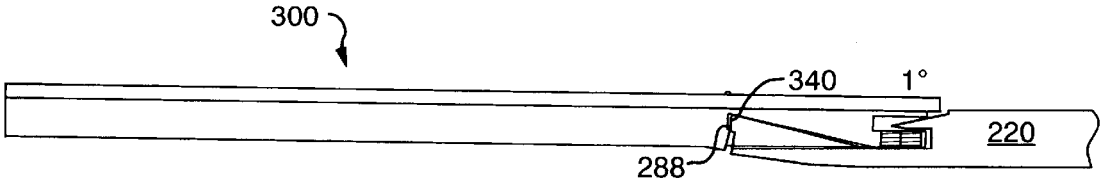
Figure 18H:
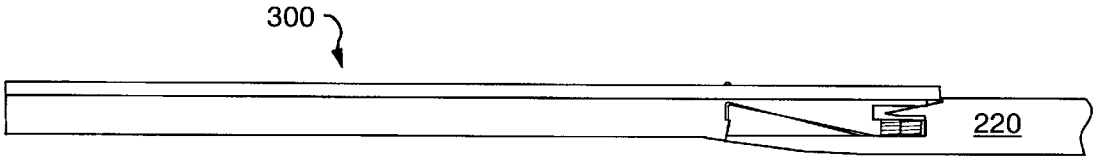

A neck insertion sequence is shown is FIGS. 18A through H. In FIG. 18A, neck 300 is positioned above structural body frame 220 and is angled at an angle $\alpha$ with respect to the axis of the structural body frame. Neck fork 330 is inserted into body receptacle 284 at this insertion angle $\alpha$ and the neck is rotated towards the axis of the structural body, as shown in FIGS. 18B through 18F. Once the neck 300 is aligned with body 220, neck 300 is moved axially toward structural body frame 220, thus locking neck boss 288 into neck locking receptacle 340, as shown in FIG. 18H. This locking relationship is maintained as the guitar strings are placed under tension using headstock/string retention mechanism 410 (FIG. 2). To remove the neck, the reverse procedure is utilized.

Accordingly, the disclosed invention provides an easily assembleable, modular guitar system. This system, takes advantage of interchangeable components, which allows the system to offer an inexpensive, entry level guitar and, by upgrading the components utilized in the guitar system, can provide a guitar that rivals the acoustical characteristics of even the finest quality, handmade guitars.

Modifications and substitutions by one of ordinary skill in the art are considered to be within the scope of the present invention which is not to be limited except by the claims which follow.

What is claimed is:

1. An inflatable, modular guitar system comprising, in combination:

a guitar body frame, said body frame having a central member disposed along a longitudinal axis of said body frame and a peripheral rim member defining a peripheral shape of said body frame having an upper bout and a lower bout, said peripheral rim member communicating with said central member at first and second ends of said guitar body frame;

an acoustic grill, said acoustic grill comprising first and second grill sections, said first and second grill sections each having a peripheral edge corresponding to the shape of said guitar body frame and removably retained to said guitar body frame peripheral member and a free edge disposed substantially collinear with said body frame central member intermediate said first and second ends of said guitar body frame;

a guitar neck having a first end removably attached to said first end of said guitar body frame, said guitar neck having a second end attached to a headstock, said headstock including at least one guitar string tuning machine for retaining a first end of at least one guitar string and adjusting tension of said at least one guitar string;

a guitar string bridge, straddling said body frame central member and removably attached to said acoustic grill sections on opposite sides of said body frame central member, said string bridge attached to a second end of said at least one guitar string to acoustically couple said at least one guitar string to said acoustic grill sections via said bridge; and an inflatable acoustic chamber attached to said guitar body frame along said guitar body frame peripheral rim member, said inflatable acoustic chamber including a membrane communicating with said guitar body acoustic grill sections when said acoustic chamber is inflated.

2. The modular guitar system as claimed in claim 1, wherein said guitar body frame further includes first and second buttresses connecting said body frame central member to said body frame peripheral rim member substantially at said lower bout of said peripheral rim member on opposite sides of said guitar body frame.

3. The modular guitar system as claimed in claim 1, wherein said headstock is removably attached to said second end of said guitar neck, and wherein said headstock further comprises a headstock/string retention mechanism comprising a string clamp and a multi-cam lever having a plurality of positions, including a playing position, wherein said lever is positioned substantially flush with said headstock and said string clamp is released by a first cam mechanism allowing the tension of said at least one guitar string to be adjusted using said at least one guitar string tuning machine, a string retention position, wherein said first cam is rotated to engage said string clamp to maintain tension on said at least one guitar string intermediate said string clamp and said at least one guitar string tuning machine, and a headstock removal position, wherein said lever is positioned to rotate a second cam, which allows said headstock to move toward said second end of said neck to release the tension of said at least one guitar string intermediate said string clamp and said bridge, allowing said headstock, guitar neck and guitar bridge to be disassembled.

4. The modular guitar system as claimed in claim 1, wherein each said acoustic grill section is pre-stressed to minimize deformation when each said grill section is exposed to guitar string tension.

5. The modular guitar system as claimed in claim 1, wherein said grill sections comprise a grill work at least substantially matching the strength and stiffness of a wooden guitar soundboard.

6. The modular guitar system as claimed in claim 5, wherein said grill work comprises a material exhibiting less internal damping than a wooden guitar soundboard.

7. The modular guitar system as claimed in claim 6, wherein said grill material comprises plastic.

8. The modular guitar system as claimed in claim 6, wherein said grill material comprises aluminum.

9. The modular guitar system as claimed in claim 6, wherein said grill material comprises glass.

10. The modular guitar system as claimed in claim 6, wherein said grill material comprises a graphite composite material.

11. The modular guitar system as claimed in claim 6, wherein said grill work comprises a grill pitch substantially between 0.5 and 2.0 inches.

12. The modular guitar system as claimed in claim 1, wherein said guitar neck comprises a neck back member, a fingerboard recessed into said neck back member, and a neck stiffener/adjuster included within said neck back member to provide structural integrity and adjustability to said neck.

13. The modular guitar system as claimed in claim 12, wherein said neck back member comprises an injection molded member, having at least one longitudinal slot disposed therein, said slot configured to accept said neck stiffener/adjuster.

14. An inflatable, modular guitar system comprising, in combination:

a guitar body having first and second body frame sections, said first and second body frame sections each having mating surfaces along a central, longitudinal axis of said guitar system to provide a substantially rigid guitar body frame central member disposed along said central, longitudinal axis when said mating surfaces are mated, said first and second body frame sections further having peripheral rim members extending from first and second ends of said mating surfaces to define a peripheral shape of said guitar body, including an upper bout and a lower bout of said guitar body frame, said first and second body frame sections further including buttresses extending from the first end of each said body frame section mating surface to its corresponding peripheral rim member substantially at its lower bout;

an acoustic grill substantially corresponding to the shape of said guitar body, said grill comprising a grill section corresponding to each body frame section, each said grill section having a peripheral rim removably attached to said peripheral rim member of said corresponding body frame section, a central, longitudinal rim, which is free to vibrate independent of said guitar body frame and one or more bridge attachment points;

a neck having a proximal end and a distal end, said proximal end removably communicating with said guitar body at a neck end of said guitar body frame along said central longitudinal axis;

a headstock removably communicating with said distal end of said neck, said headstock including guitar string retention and tension adjustment apparatuses for retaining and tuning each string included with said guitar at a headstock end of each string;

a guitar bridge straddling said substantially rigid guitar body frame central member and communicating with said grill sections at said bridge attachment points on opposite sides of said central member, said guitar bridge removably retaining each said string at a bridge end of each said string, said guitar bridge acoustically coupling said guitar strings to said acoustic grill; and an inflatable bladder removably attached to said guitar body frame peripheral rim, said bladder including a membrane communicating with said acoustic grill and providing a volume of air defining a guitar body corresponding to the shape of said guitar body frame.

15. The inflatable, modular guitar system as claimed in claim 14, wherein said body frame mating surfaces comprise a female dovetail disposed substantially along the entire length of a first of said body frame sections and a hollow male dovetail disposed substantially along the entire length of a second of said body frame sections, said hollow male dovetail providing flexibility to account for body frame section irregularities.

16. The inflatable, modular guitar system as claimed in claim 14, wherein said body frame mating surfaces comprise a female dovetail disposed substantially along the entire length of said first body frame section and a hollow, segmented male dovetail disposed substantially along the length of said second body frame section, said segmented hollow male dovetail providing enhanced flexibility to account for body frame irregularities when mated with said female dovetail.

17. The inflatable, modular guitar system as claimed in claim 16, wherein said segmented male dovetail comprises alternating upper and lower dovetail projections.

18. The inflatable, modular guitar system as claimed in claim 15, wherein said hollow male dovetail further comprises a convex mating surface configured to mate with said female dovetail along a single line of contact along the length of said guitar body frame central member.

19. The inflatable, modular guitar system as claimed in claim 16, wherein said hollow male dovetail further comprises a convex mating surface configured to mate with said female dovetail along a single, broken line of contact along the length of each segmented dovetail projection.

20. The inflatable, modular guitar system as claimed in claim 14, wherein each acoustic grill section comprises a grill work including grill mesh members overlaid with grill strength members, said grill strength members configured to provide maximum strength corresponding to said bridge attachment points and to provide maximum acoustic grill flexibility at the rim of said grill sections at locations remote from said bridge attachment points.

* * * * *